US008393252B2

(12) United States Patent
Hsieh

(10) Patent No.: US 8,393,252 B2
(45) **Date of Patent: *Mar. 12, 2013**

(54) WRENCH

(75) Inventor: Chih-Ching Hsieh, Taichung County (TW)

(73) Assignee: Chihching Hsieh, Taichung County (TW)

( * ) Notice: Subject to any disclaimer, the term of this patent is extended or adjusted under 35 U.S.C. 154(b) by 337 days.

This patent is subject to a terminal disclaimer.

(21) Appl. No.: 12/793,680

(22) Filed: Jun. 4, 2010

(65) Prior Publication Data

US 2011/0209585 A1 Sep. 1, 2011

(30) Foreign Application Priority Data

Feb. 26, 2010 (TW) ..... 99105706 A

(51) Int. Cl.
*B25B 13/46* (2006.01)
*B25B 15/04* (2006.01)

(52) U.S. Cl. ..... 81/63.2; 81/58.4; 81/436

(58) Field of Classification Search ..... 81/60–63.2, 81/58, 58.3, 58.4, 59.1, 436
See application file for complete search history.

(56) References Cited

U.S. PATENT DOCUMENTS

| | | | | |
|---|---|---|---|---|
| 6,951,154 | B2 * | 10/2005 | Hsien | 81/60 |
| 7,107,877 | B2 * | 9/2006 | Lee | 81/63 |
| D586,634 | S * | 2/2009 | Lai | D8/21 |
| 2003/0188605 | A1 * | 10/2003 | Chang | 81/60 |
| 2010/0186554 | A1 * | 7/2010 | Hsieh | 81/63 |

* cited by examiner

*Primary Examiner* — Hadi Shakeri
(74) *Attorney, Agent, or Firm* — CKC & Partners Co., Ltd.

(57) ABSTRACT

A wrench includes a body, a first driving head, a second driving head, a first ratcheting mechanism and a second ratcheting mechanism. The first ratcheting mechanism connects the first driving head to the body. The second ratcheting mechanism connects the second driving head to the body.

12 Claims, 3 Drawing Sheets

WRENCH

RELATED APPLICATIONS

The application claims priority to Taiwan Application Serial Number 99105706, filed Feb. 26, 2010, which is herein incorporated by reference.

BACKGROUND

1. Technical Field

The present disclosure relates to hand tools. More particularly, the present disclosure relates to wrenches.

2. Description of Related Art

A wrench or spanner is a tool used to provide grip and mechanical advantage in applying torque to turn objects—usually rotary fasteners, such as nuts and bolts—or keep them from turning. Common wrenches may include open-end wrenches, box-end wrenches, combination wrenches, flare-nut wrenches, adjustable wrenches, socket wrenches, torque wrenches, crowfoot wrenches, saltus wrenches, box spanners, and striking face box wrenches. Furthermore, general wrenches for screws and bolts with internal sockets may include Allen wrench, Bristol wrench, and Torx wrench.

SUMMARY

According to one embodiment of the present invention, a wrench includes a body, a first driving head, a second driving head, a first ratcheting mechanism connects the first driving head to the body. The second ratcheting mechanism connects the second driving head to the body.

DETAILED DESCRIPTION

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically depicted in order to simplify the drawings.

Figure 1:
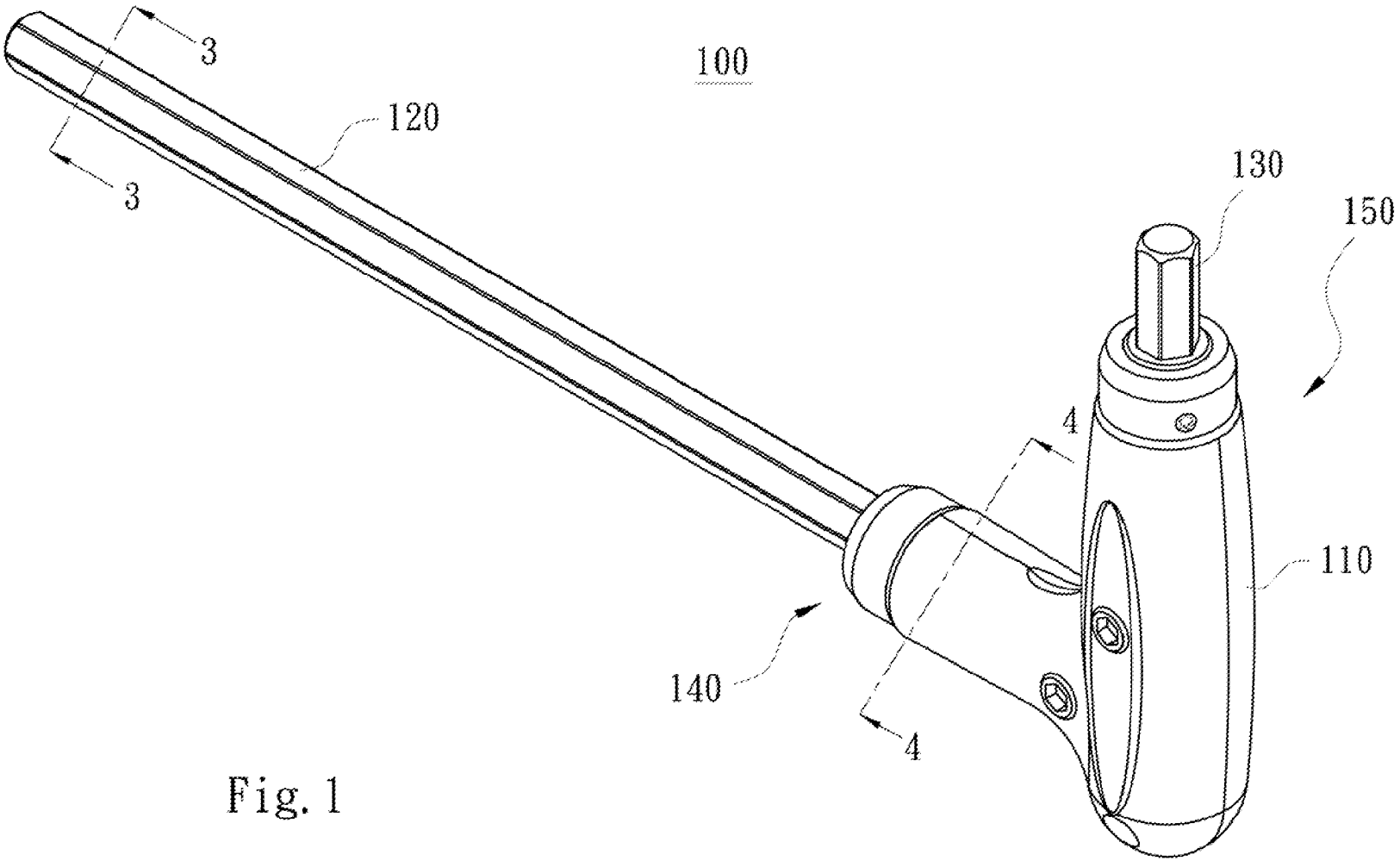
FIG. 1 is a three dimensional view of a wrench according to one embodiment of the present invention.

FIG. 1 is a three dimensional view of a wrench 100 according to one embodiment of the present invention. As shown in FIG. 1, the wrench 100 includes a body 110, a first driving head 120, a second driving head 130, a first ratcheting mechanism 140 and a second ratcheting mechanism 150. The first ratcheting mechanism 140 connects the first driving head 120 to the body 110. The second ratcheting mechanism 150 connects the second driving head 130 to the body 110.

In use, the first ratcheting mechanism 140 allows the first driving head 120 to only rotate in one direction relative to the body 110. On the other hand, the second ratcheting mechanism 150 allows the second driving head 130 to only rotate in one direction relative to the body 110. Therefore, the wrench 100 can tighten or loosen a nut with a reciprocating motion, without being removed or refitted after each turn.

Figure 2:
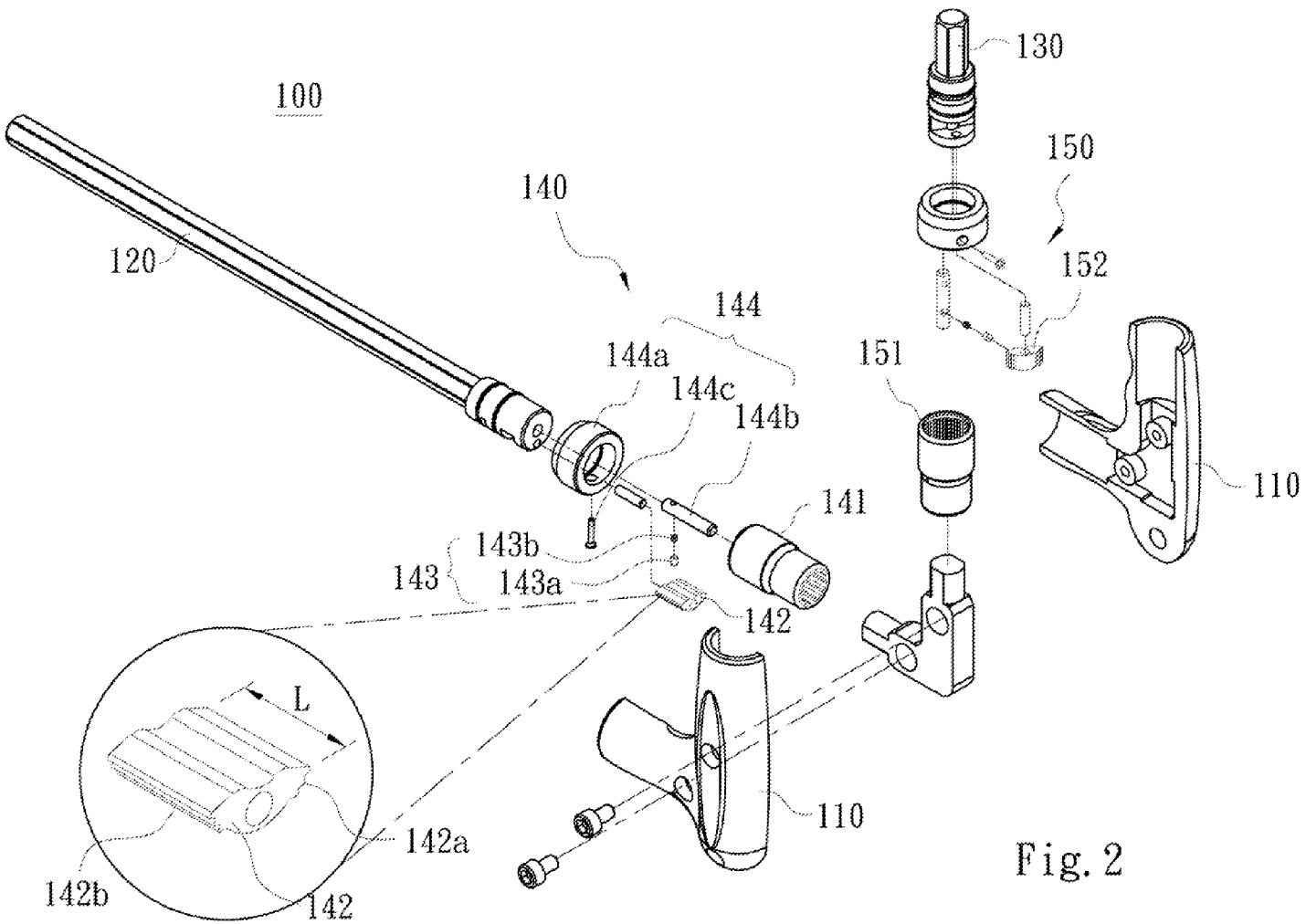
FIG. 2 is an exploded view of the wrench of FIG. 1.
Figure 3:
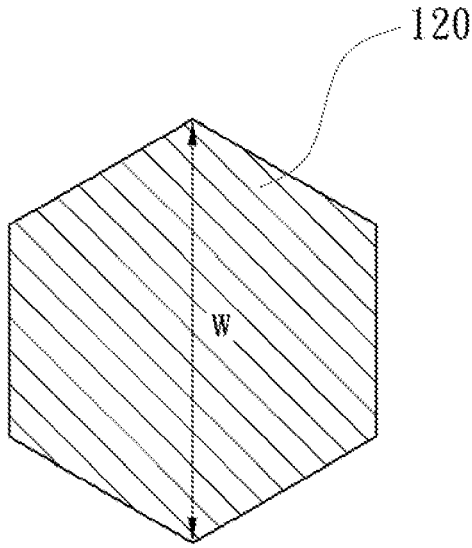
FIG. 3 is a sectional view taken along the line 3-3 of FIG. 1.

FIG. 2 is an exploded view of the wrench 100 of FIG. 1, and FIG. 3 is a sectional view taken along the line 3-3 of FIG. 1. As shown in FIG. 2, the body 110 is a combination of two hollow shells and also the place of application. Since the body 110 is a T-shape, the wrench 100 is named a T-wrench.

The first driving head 120 can be replaced with different types, sizes or shapes, such as a cross bit or a socket, to meet different requirements.

The second driving head 130 is substantially the same as the first driving head 120. In the present embodiment, the first driving head 120 is is perpendicular to the second driving head 130.

The first ratcheting mechanism 140 includes a first gear 141, a first pawl 142 and a first elastic member 143. The first gear 141 connected to the body 110. In the present embodiment, the first gear 141 is a barrel-shaped gear.

The first pawl 142 is pivotally connected to the first driving head 120 and has a first teeth portion 142*a* and a second teeth portion 142*b*. When the first teeth portion 142*a* engages the first gear 141, the first teeth portion 142*a* allows the first gear 141 to only rotate in a first direction I relative to the first driving head 120. When the second teeth portion 142*b* engages the first gear 141, the second teeth portion 142*b* allows the first gear 141 to only rotate in a second direction II relative to the first driving head 120. If the first pawl 142 does not engage the first gear 141, the first driving head 120 is idle relative to the first gear 141.

Specifically, the length L of the teeth of the first pawl 142 is greater than the width W of the first driving head 120 in the present embodiment.

The term "length" as used herein means the longest dimension of an object. For example, the length L of the teeth of the first pawl 142 as disclosed herein means the longest dimension of the teeth of the first pawl 142. On the other hand, the width W of the first driving head 120 as disclosed herein means the distant between two furthest vertexes of the first driving head 120, as shown in FIG. 3.

The friction between the first pawl 142 and the first gear 141 can bear larger force if the length L of the teeth of the first pawl 142 is greater than the width W of the first driving head 120. Therefore, the first pawl 142 and the first gear 141 won't easily damage by the improper force exertion.

Return to FIG. 2. The first elastic member 143 pushes the first pawl 142 such that the teeth of the first pawl 142 will engage the first gear 141. The first elastic member 143 includes a first bullet-shaped cover 143*a* and a first spring 143*b*. The first spring 143*b* pushes the first bullet-shaped cover 143*a* against the first pawl 142. That is, one end of the first spring 143*b* is against the first bullet-shaped cover 143*a*, and the other end of the first spring 143*b* is against the first shaft 144*b*. It is appreciated that many other devices may be used as the first elastic member 143, for instance, a leaf spring may be substituted for the first bullet-shaped cover 143*a* and the first spring 143*b* as the first elastic member 143.

In one or more embodiments, the first ratcheting mechanism 140 may further include a first switching mechanism 144 to move the first elastic member 143 to push the first teeth portion 142*a* of the first pawl 142 to engage the first gear 141.

Specifically, the first switching mechanism 144 may include a first switching ring 144*a*, a first shaft 144*b* and a first pin 144*c*. The first switching ring 144*a* is rotatably disposed around the first driving head 120. The first shaft 144*b* passes through the first driving head 120, wherein the first elastic member 143 is disposed on the side of the first shaft 144*b*. The first pin 144*c* fastens the first switching ring 144*a* and the first shaft 144*b*.

Figure 4:
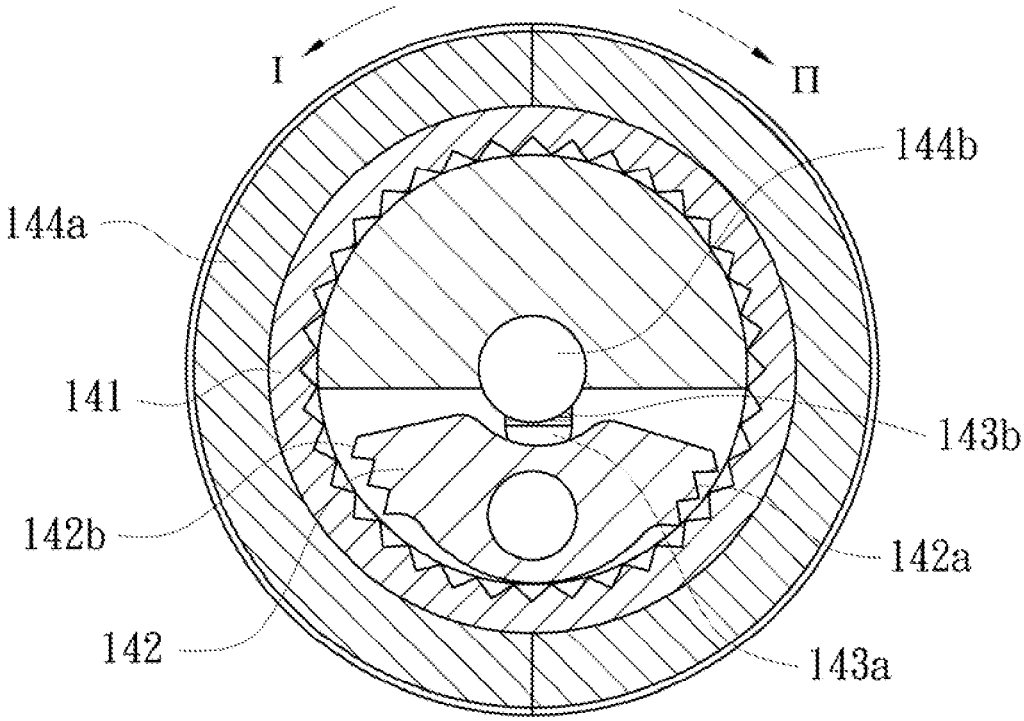
FIG. 4 is a sectional view taken along the line 4-4 of FIG. 1.

FIG. 4 is a sectional view taken along the line 4-4 of FIG. 1. As shown in FIG. 4, the first spring 143*b* is connected to the first shaft 144*b* and pushes the first pawl 142 by the first bullet-shaped cover 143*a*. In other words, turning the first switching ring 144*a* will moves both the first spring 143*b* and the first bullet-shaped cover 143*a* by the first shaft 144*b*.

The user turns the first switching ring 144*a* counterclockwise to rotate the first shaft 144*b*. Then, the first elastic member 143 is moved to push the first teeth portion 142*a* to engage the first gear 141 by the rotational motion of the first shaft 144*b*. As a result of the engagement of the first teeth portion 142*a* with the first gear 141, the first gear 141 is only allowed to rotate in the first direction I relative to the first driving head 120.

Alternatively, the user turns the first switching ring 144*a* clockwise to rotate the first shaft 144*b*. Then, the first elastic member 143 is moved to push the second teeth portion 142*b* to engage the first gear 141 by the rotational motion of the first shaft 144*b*. As a result of the engagement of the second teeth portion 142*b* with the first gear 141, the first gear 141 is only allowed rotate in the second direction II relative to the first driving head 120. Therefore, the user can tighten or loosen a nut with a reciprocating motion, without being removed or refitted after each turn.

The second ratcheting mechanism 150 is substantially the same as the first ratcheting mechanism 140.

Common wrenches are usually made integrally or having the linking-up ratcheting mechanism. In other words, the user has to apply larger torsion to drive both ratcheting mechanism of the wrench.

Specifically, the first ratcheting mechanism 140 and the second ratcheting mechanism 150 are connected to different ends of the body 110 in the present embodiment. Hence, the first ratcheting mechanism 140 and the second ratcheting mechanism 150 can operate individually without constraining each other. That is, the user applies force to drive neither the first ratcheting mechanism 140 nor the second ratcheting mechanism 150 of the wrench 100 to tighten or loosen a nut. The user can avoid unnecessary waste of the torsion as well.

In one or more embodiments, the elements in the first ratcheting mechanism 140 and the second ratcheting mechanism 150 can be replaced with different sizes to meet different requirements. For instant, the size of the first gear 141 is different from the second gear 151; the size of the first pawl 142 is different from the second pawl 152. It can reduce the inconvenient of changing different sizes of the wrenches.

The reader's attention is directed to all papers and documents which are filed concurrently with his specification and which are open to public inspection with this specification, and the contents of all such papers and documents are incorporated herein by reference.

All the features disclosed in this specification (including any accompanying claims, abstract, and drawings) may be replaced by alternative features serving the same, equivalent or similar purpose, unless expressly stated otherwise. Therefore, unless expressly stated otherwise, each feature disclosed is one example only of a generic series of equivalent or similar features.

Any element in a claim that does not explicitly state "means for" performing a specified function, or "step for" performing a specific function, is not to be interpreted as a "means" or "step" clause as specified in 35 U.S.C. §112, 6th paragraph. In particular, the use of "step of" in the claims is not intended to invoke the provisions of 35 U.S.C. §112, 6th paragraph.

What is claimed is:

1. A wrench comprising:
- a body;
- a first driving head;
- a second driving head;
- a first ratcheting mechanism connecting the first driving head to the body, the first ratcheting mechanism comprising:
  - a first gear connected to the body;
  - a first pawl pivotally connected to the first driving head and having a plurality of teeth disposed thereon; and
  - a first elastic member for pushing the first pawl such that the teeth of the first pawl will engage the first gear, wherein the length of the teeth of the first pawl is greater than the width of the first driving head; and
- a second ratcheting mechanism connecting the second driving head to the body.

2. The wrench of claim 1, wherein the first elastic member comprises:
- a first bullet-shaped cover; and
- a first spring for pushing the first bullet-shaped cover against the first pawl.

3. The wheel wrench of claim 1, wherein the first ratcheting mechanism further comprises:
- a first switching mechanism for moving the first elastic member to push the first teeth portion of the first pawl to engage the first gear, wherein the teeth has a first teeth portion that allows the first near to only rotate in a first direction relative to the first driving head when the first teeth portion engages the first gear and a second teeth portion that allows the first gear to only rotate in a second direction relative to the first driving head when the second teeth portion engages the first gear.

4. The wrench of claim 3, wherein the first elastic member comprises:
- a first bullet-shaped cover; and
- a first spring for pushing the first bullet-shaped cover against the first pawl.

5. The wrench of claim 3, wherein the first switching mechanism comprises:
- a first switching ring rotatably disposed around the first driving head;
- a first shaft passing through the first driving head, wherein the first elastic member is disposed on the side of the first shaft; and
- a first pin fastening the first switching ring and the first shaft.

6. The wrench of claim 1, wherein the second ratcheting mechanism comprises:
- a second gear connected to the body;
- a second pawl pivotally connected to the second driving head and having a plurality of teeth disposed thereon; and
- a second elastic member for pushing the second pawl such that the teeth of the second pawl will engage the second gear.

7. The wrench of claim 6, wherein the second elastic member comprises:
- a second bullet-shaped cover; and
- a second spring for pushing the second bullet-shaped cover against the second pawl.

8. The wrench of claim 6, wherein the length of the teeth of the second pawl is greater than the width of the second driving head.

9. The wheel wrench of claim 1, wherein the second ratcheting mechanism comprises:

a second gear connected to the body;

a second pawl pivotally connected to the second driving head and having a first teeth portion that allows the second gear to only rotate in a first direction relative to the second driving head when the first teeth portion engages the second gear and a second teeth portion that allows the second gear to only rotate in a second direction relative to the second driving head when the second teeth portion engages the second gear; and a second elastic member; and a second switching mechanism for moving the second elastic member to push the first teeth portion of the second pawl to engage the second gear.

10. The wrench of claim 9, wherein the second elastic member comprises:

a second bullet-shaped cover; and a second spring for pushing the second bullet-shaped cover against the second pawl.

11. The wrench of claim 9, wherein the second switching mechanism comprises:

a second switching ring rotatably disposed around the second driving head;

a second shaft passing through the second driving head, wherein the second elastic member is disposed on the side of the second shaft; and a second pin fastening the second switching ring and the second shaft.

12. The wrench of claim 1, wherein the first driving head is perpendicular to the second driving head.

* * * * *